US009265335B2

(12) United States Patent
Foley et al.

(10) Patent No.: US 9,265,335 B2
(45) Date of Patent: Feb. 23, 2016

(54) TOOTHBRUSH WITH FORMABLE HANDLE

(71) Applicant: Radius Corporation, Kutztown, PA (US)

(72) Inventors: Kevin Foley, Kempton, PA (US); James Eldon, Barto, PA (US)

(73) Assignee: Radius Corporation, Kutztown, PA (US)

( * ) Notice: Subject to any disclaimer, the term of this patent is extended or adjusted under 35 U.S.C. 154(b) by 0 days.

(21) Appl. No.: 14/594,075

(22) Filed: Jan. 9, 2015

(65) Prior Publication Data

US 2015/0143651 A1 May 28, 2015

Related U.S. Application Data

(62) Division of application No. 14/089,735, filed on Nov. 25, 2013, now Pat. No. 8,931,855.

(51) Int. Cl.

| | |
|---|---|
| ***A46B 5/02*** | (2006.01) |
| ***A46B 9/04*** | (2006.01) |
| ***A46B 7/04*** | (2006.01) |
| ***A46B 5/00*** | (2006.01) |

(52) U.S. Cl.

CPC ..... *A46B 5/021* (2013.01); *A46B 5/0095* (2013.01); *A46B 7/04* (2013.01); *A46B 7/042* (2013.01); *A46B 9/04* (2013.01)

(58) Field of Classification Search

CPC ..... A46B 5/02; A46B 9/04
USPC ..... 15/143.1, 144.1, 145, 167.1
See application file for complete search history.

(56) References Cited

U.S. PATENT DOCUMENTS 4,283,808 A * 8/1981 Beebe ..... A46B 5/02 15/145

* cited by examiner

*Primary Examiner* — Monica Carter
*Assistant Examiner* — Stephanie Berry
(74) *Attorney, Agent, or Firm* — Invention to Patent Services; Alex Hobson

(57) ABSTRACT

A formable handle toothbrush has a handle portion that allows a user to heat and form the handle to the shape of their hand to provide for more secure grip of the toothbrush. In one embodiment, a hand formable toothbrush has a toothbrush head attached to a shank that can be inserted into a socket within the toothbrush handle. This configuration allows for the use of replacement toothbrush heads. This makes manufacturing of higher cost handles more economical, as the formable handle portions would not be thrown out when the toothbrush head needs replacement. To customize the formable handle portion, a user may simply place the toothbrush, or handle portion of the toothbrush, in boiling water for a period of time and then remove the toothbrush handle, allow it to cool to a safe temperature and then grasp the handle to form it into the shape of their hand.

18 Claims, 14 Drawing Sheets

TOOTHBRUSH WITH FORMABLE HANDLE

CROSS REFERENCE TO RELATED APPLICATIONS

The application is a divisional of U.S. patent application Ser. No. 14/089,735, entitled Toothbrush With Formable Handle, filed on Nov. 25, 2013 and currently pending; the entirety of which is incorporated by reference herein.

BACKGROUND OF THE INVENTION

1. Field of the Invention

The present invention relates to a toothbrush having a handle that can be formed into the shape of a user's hand and can be configured for left or right-handed users.

2. Background

Some people, including children and people with arthritis, may find it difficult to grasp and manipulate a standard narrow handle toothbrush. The handles may be too small or may slip or twist during use, as their grip is not tight enough. Toothbrushes with narrow symmetric handles do not provide sufficient grip for these users.

Some toothbrushes are made with handles that are asymmetric to fit more comfortably in a person's hand. The asymmetric geometry is typically made such that the toothbrush head will face the user when grasped with the proper hand. Both left-handed and right-handed toothbrushes have to be provided to accommodate all users. Making toothbrushes with both left-handed and right-handed handles requires additional tooling, administrative costs, inventory and shelf space.

SUMMARY OF THE INVENTION

The invention is directed to a toothbrush having a handle that can be formed into the shape of a user's hand and can be configured for left or right-handed users. In an exemplary embodiment, a hand formable toothbrush comprises a toothbrush head attached to a shank that can be inserted into a socket within the toothbrush handle. This configuration allows for the use of replacement toothbrush heads, whereby only the toothbrush head, and/or head and shank, may be replaced. This makes providing handles with a formable handle portion, or that comprise higher cost materials, more economical, as they would not be thrown out when the toothbrush head needs replacement.

The handle of the hand formable toothbrush described herein comprises a formable handle portion. A formable handle portion may be a lower portion of the handle, or may be an exterior portion of a handle configured around an inner support that is more rigid than the formable handle portion, in one embodiment, the handle consists essentially of formable material, such as a plastic or foam that effectively softens when heated to allow a user to safely shape the formable material in their hand. For example, a formable material may be a plastic comprising the polymer ethylene vinyl acetate (EVA), polyurethane and the like. The ratios of the copolymers in EVA, can be varied to change the melting and freezing point of the copolymer. As the ratio of vinyl acetate increases, the melting and freezing points of the EVA copolymer decrease. A heat formable material may be heated above a melting or softening point to enable the polymer to be formed, and then allowed to cool below its freezing point to set and retain the formed shape.

A temperature indicator may be provided with the toothbrush and may be attached to the handle, portion of the toothbrush. A user may place the handle of the toothbrush in boiling or heated water and observe the temperature indicator. When the temperature indicator indicates the handle has reached an effective temperature for forming, the user may remove the toothbrush handle and form it. A temperature indicator may change color, such as from red to green, for example, when the temperature exceeds a preset value. Any suitable type of indicator strip may be used.

A heat formable material may be configured to enable a user to simply place the toothbrush or handle portion of the toothbrush in boiling water for a period of time and then remove the toothbrush handle, allow it to cool to a safe temperature and then grasp the handle to form it into the shape of their hand. The handle will take on the shape of the user hand to produce an asymmetric handle having an asymmetric geometry about a centerline of the handle. In an exemplary embodiment, the formed handle will have finger recesses and/or a protrusion that is shaped to fit into the palm of the user's hand. An asymmetric handle will provide a hand specific, left or right hand, geometry that will conform well to the user's hand and enable better grip and retention of the toothbrush.

The handle of a hand formable toothbrush may be provided with a symmetric geometry about a centerline of the toothbrush handle. A user may then form the handle formable portion to the shape of their hand as desired. In another embodiment however, the handle may be provided with an asymmetric geometry that conforms generally to the shape of a hand having a protrusion to fit within the palm portion of a user's hand, for example. This left and/or right hand specific original handle geometry may allow for easier formation of the handle to a desired final shape. The user may heat the original hand specific handle and further shape the handle to the shape of their hand.

A formable handle portion may be made out of any suitable material including plastic, rubber, elastomer, foam, composites, combinations thereof and the like. The formable handle portion is configured to soften at any suitable temperature to effectively enable forming to a user's hand, including about 160° C. or less, about 80° C. or less, about 60° C. or less, about 50° C. or less and any range between and including the temperatures provided. A preferred formable handle material is EVA, that will soften or melt at a temperature of approximately 145° F. and harden or freeze at a temperature of approximately 106° F.

The handle may have any suitable length including, but not limited to, about 5 cm or more, about 8 cm or more, about 10 cm or more, about 12 cm or more and any range between and including the length values provided. A handle may comprise an inner support that allows for a soft outer portion that may further improve grip and retention of the toothbrush during use. A toothbrush handle or a formable handle portion may have any suitable hardness including, but not limited to, a durometer of about 50 shore A or less, about 50 shore OO or less, about 30 shore OO or less and any range between and including the durometer values provided.

In one embodiment, the toothbrush handle comprises an integral socket, or a socket formed directly in the handle material for receiving a shank having a toothbrush head coupled to the opposing end. A socket enables replacement of toothbrush heads without disposing of the handle. In another exemplary embodiment, a hand formable toothbrush comprises an armature comprising a socket that is configured at least partially within said handle. An armature may be made out of a material that is more rigid than the handle material and may provide for more secure retention of a shank attached therein. For example, an armature may be made out of a rigid hard plastic and the handle may be made out of a soft elastomer or foam. The soft foam may improve grip while the metal armature provides stiffness along the handle length to prevent flexing of the handle. An armature may be made out of any suitable material including, but not limited to, wood, metal, plastic, rubber, elastomer, composites, combinations thereof and the like. An armature may extend any suitable length along the handle including, but not limited to, about one-quarter the handle length or more, about one-third the handle length or more, about one-half the handle length or more, about three-quarters the handle length or more, substantially the entire handle length, and any range between and including the socket lengths provided. Likewise, an integral or armature socket may extend down into the handle any suitable length including, but not limited to, about one-quarter the handle length or more, about one-third the handle length or more, about one-half the handle length or more, about three-quarters the handle length or more, substantially the entire handle length, and any range between and including the socket lengths provided.

In an exemplary embodiment, the toothbrush head is attached to a shank and the shank is configured for insertion into the socket. The socket may comprise an attachment feature that is configured to align with a shank attachment feature to detachably attach the shank within the socket. In an exemplary embodiment, the socket comprises a first attachment feature on a first side of said socket and a second attachment feature on a second, and opposing, side to said first side of said socket, whereby the shank can be configured such that the toothbrush is in a left-handed or a right-handed configuration. The socket attachment feature may be a recess or a protrusion configured to align and nest with a shank attachment feature. In an exemplary embodiment, the socket comprises a protrusion attachment feature and the shank comprises a recess attachment feature. In an exemplary embodiment, a socket comprises a first alignment feature on a first side of said socket and a second alignment feature on a second and opposing side to said first side of said socket, whereby a shank comprising a shank alignment feature can only be inserted into the socket with the shank alignment feature aligned with the socket alignment feature such that the toothbrush can be configured in a left-handed or a right-handed configuration. The socket first and second alignment features may comprise a socket channel, and the shank alignment feature may comprise a protrusion configured to fit within said socket channel, for example. In an alternate embodiment however, the socket first and second alignment features may comprise a socket protrusion, and the shank alignment feature may comprise a shank channel or recess configured to fit around the socket protrusion. Any combination of features, such as attachment features and alignment features, may be configured on a socket and shank to enable the shank to be inserted into and retained within the socket.

The hand formable toothbrush, as described herein, may be manual toothbrush comprising no powered elements, as is the case with electric toothbrushes that are electrically powered to move the head, armature, or bristles of the toothbrush. In an exemplary embodiment, the toothbrush head is attached to the shank and is a one-piece unit wherein the toothbrush head cannot be detached from the shank. A one-piece unit head and shank may be molded as a one-piece unit and the bristles may be attached to the molded part. In another embodiment, the toothbrush head may be detachably attached to the shank. Any suitable attachment means may be used to attach the toothbrush head to the shank. A shank may be any suitable length including, but not limited to, about 1 cm or more, about 2 cm or more, about 4 cm or more, about 6 cm or more, about 8 cm or more and any range between and including the values provided.

In an exemplary embodiment, a hand formable toothbrush comprises a toothbrush head attached to a shank, an asymmetric handle having a handle length and a hand specific geometry, and an armature attached to the handle comprising a socket. The shank comprises a shank attachment feature. The socket comprises a first and second attachment feature configured on a first and second opposing side, respectively, of said socket. The shank may be inserted and attached to the socket such that the toothbrush is in a left-handed or a right-handed configuration. The shank may be inserted into the socket such that the shank attachment feature aligns with the first socket attachment feature, or it may be turned 180 degrees and inserted such that the shank attachment feature aligns with the second socket attachment feature. In an exemplary embodiment, the armature socket first and second attachment features comprise a socket recess and the shank attachment feature comprises a protrusion configured to nest is the socket recess when inserted to a proper depth. In another embodiment, the armature socket comprises a first alignment feature on a first side of the socket and a second alignment feature on a second and opposing side of the socket, whereby the shank, comprising a shank alignment feature, can only be inserted into the socket with the shank alignment feature aligned with the socket alignment feature such that the toothbrush can be configured in a left-handed or a right-handed configuration.

In an exemplary embodiment, a method of forming a formable toothbrush handle to a user's hand shape comprises the steps of: providing a hand formable toothbrush as described herein; heating at least the handle portion of the toothbrush; and placing the heated handle in a user's hand whereby the user squeezes the handle to form a formable handle portion into a shape of said user's hand to create a hand shaped toothbrush with an asymmetric handle. The hand shaped toothbrush handle produced has an asymmetric handle comprising an asymmetric geometry about a centerline of said handle that comprises a hand specific geometry.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of his specification, illustrate embodiments of the invention, and together with the description serve to explain the principles of the invention.

DETAILED DESCRIPTION OF THE ILLUSTRATED EMBODIMENTS

Figure 1A:
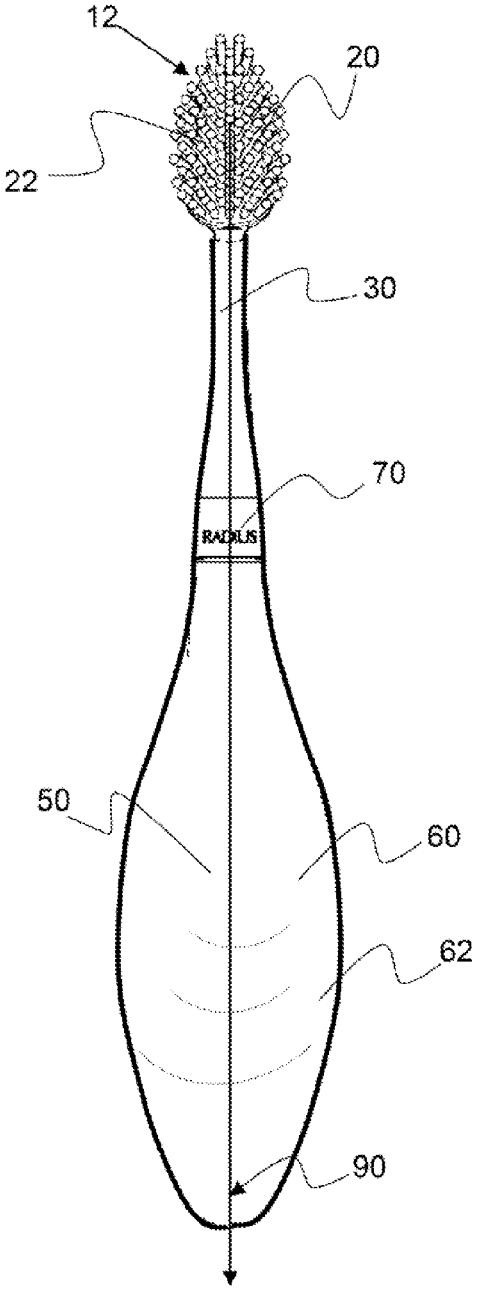

FIG. 1A shows a front view of an exemplary hand formable toothbrush having a toothbrush head attached to a shank and a handle comprising a hand formable portion.

Figure 1B:
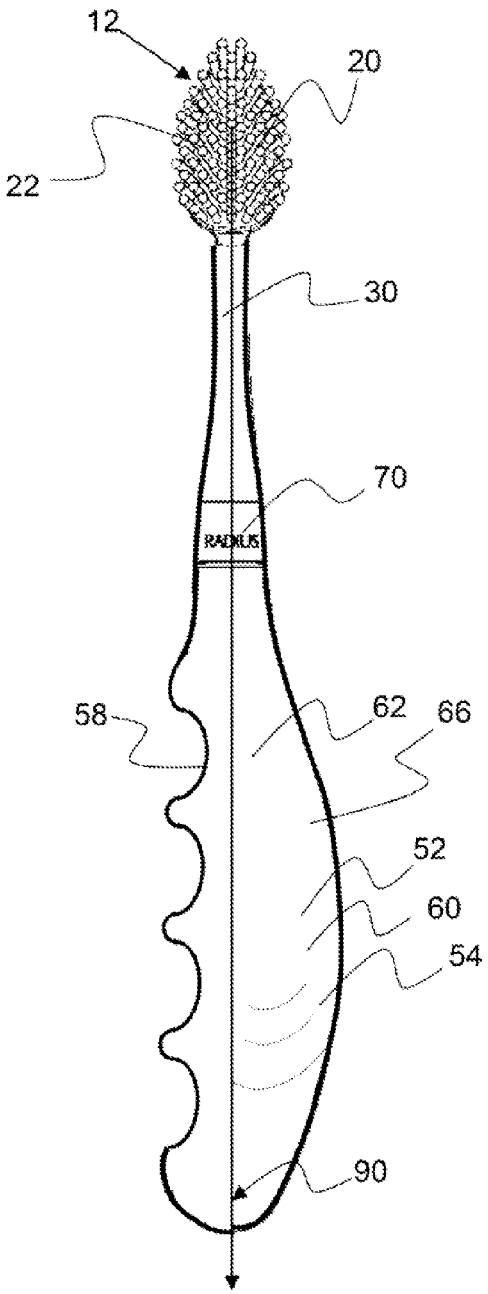

FIG. 1B shows a front view of the hand formable toothbrush shown in FIG. 1A after with a formed handle wherein the handle has been shaped to a user hand.

Figure 2:
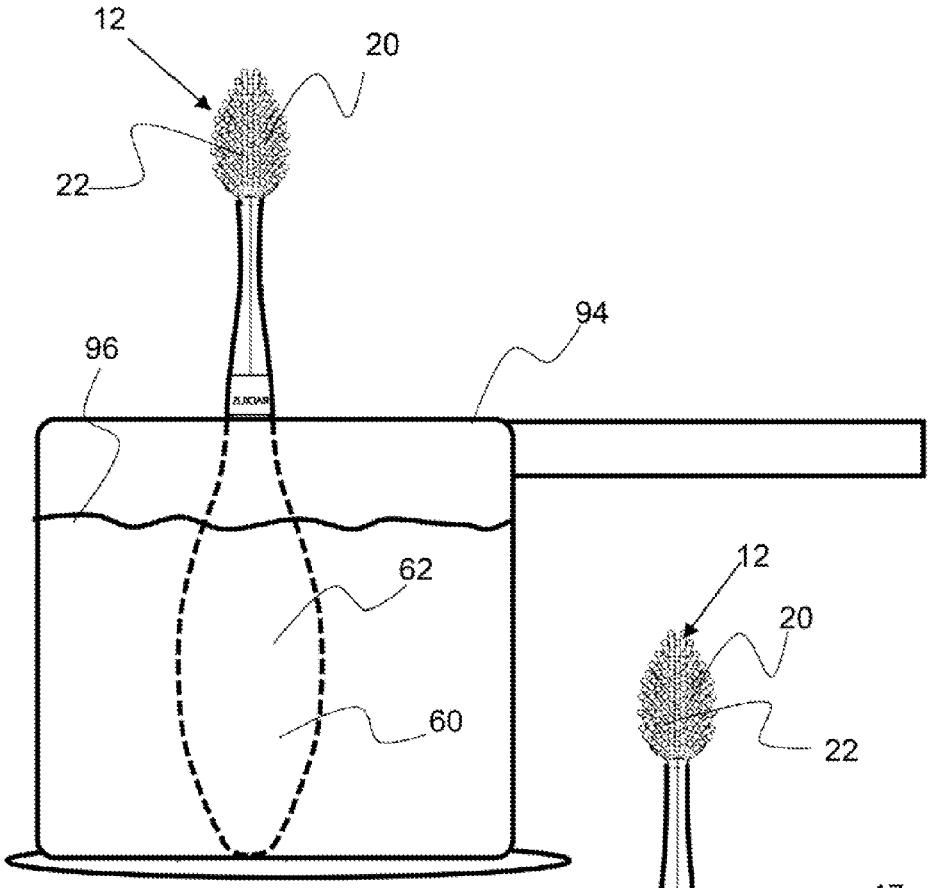

FIG. 2 shows a front view of an exemplary hand formable toothbrush in a vessel containing heated water.

Figure 3:
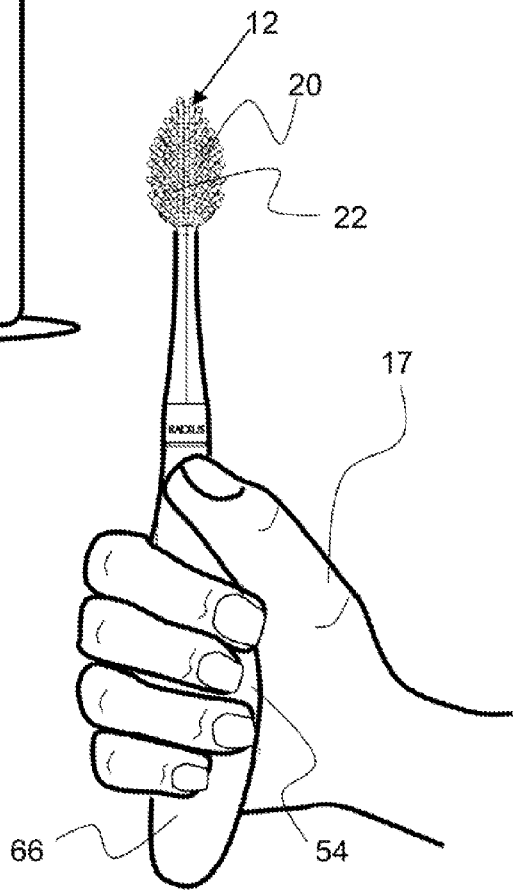

FIG. 3 shows a front view of the hand formable toothbrush shown in FIG. 2 after removal from the heated water and the formable handle portion being shaped in a user's hand.

Figure 4A:
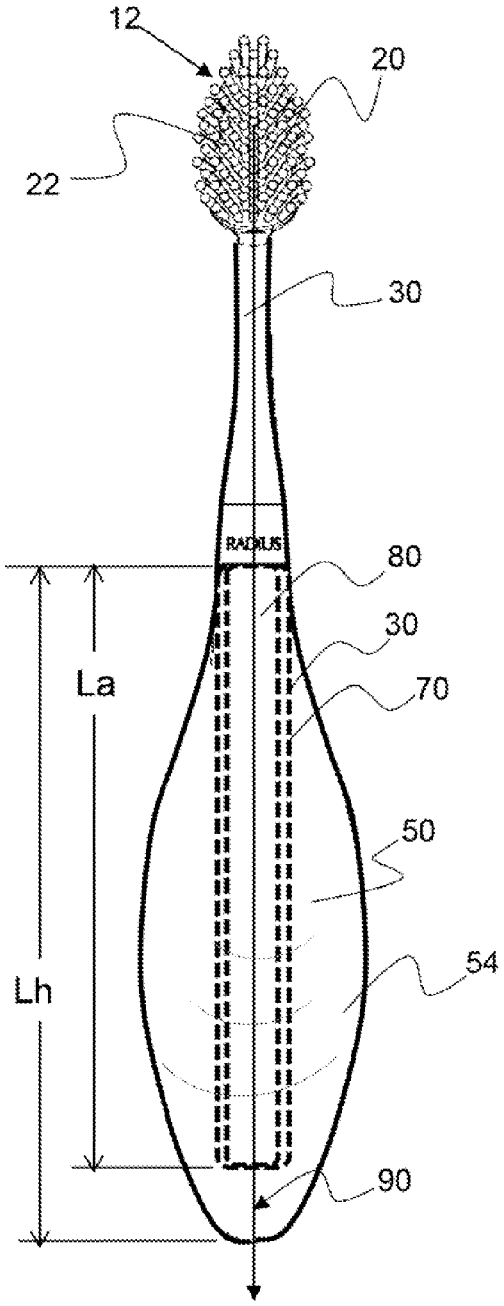

FIG. 4A shows a front view of a hand formable toothbrush having an armature extending down within the handle.

Figure 4B:
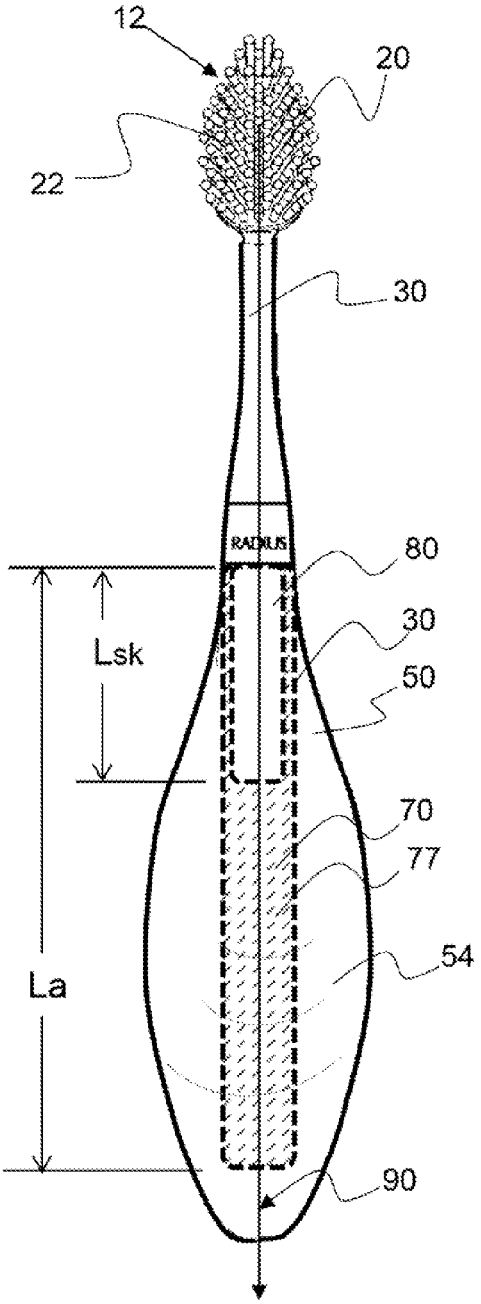

FIG. 4B shows a front view of a hand formable toothbrush having an armature extending down within the handle, substantially the entire length of the handle, and a socket that extends a portion of the length of the handle.

Figure 5:
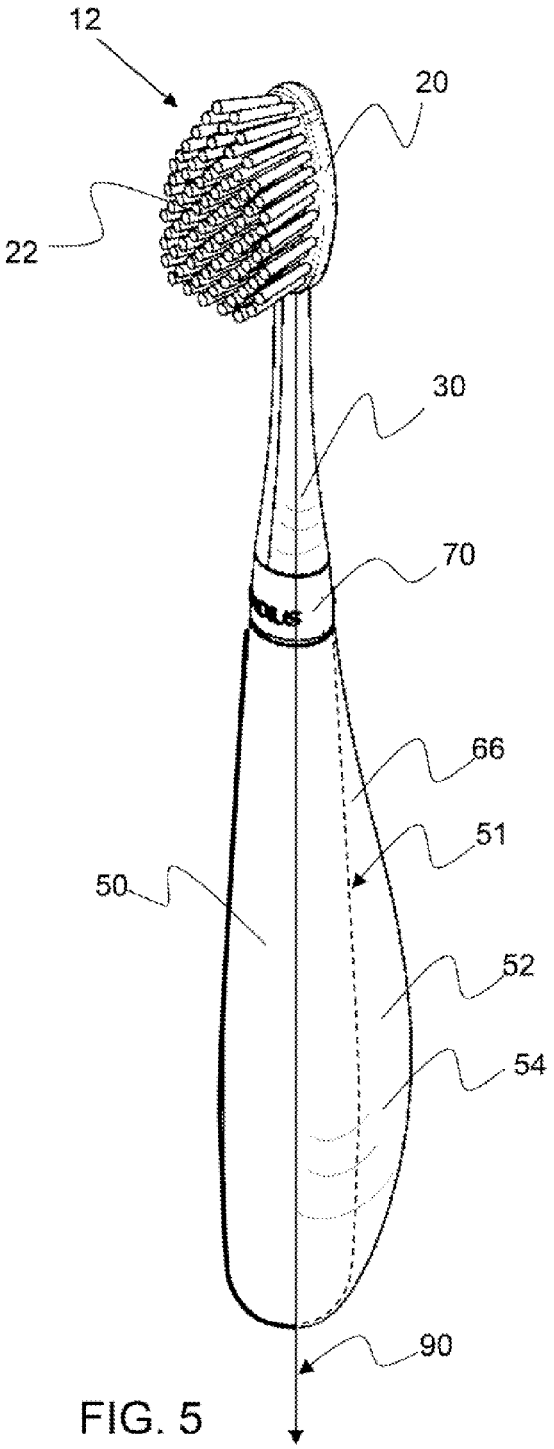

FIG. 5 shows an isometric view of an exemplary hand formable toothbrush having a toothbrush head, a shank and a handle.

Figure 6:
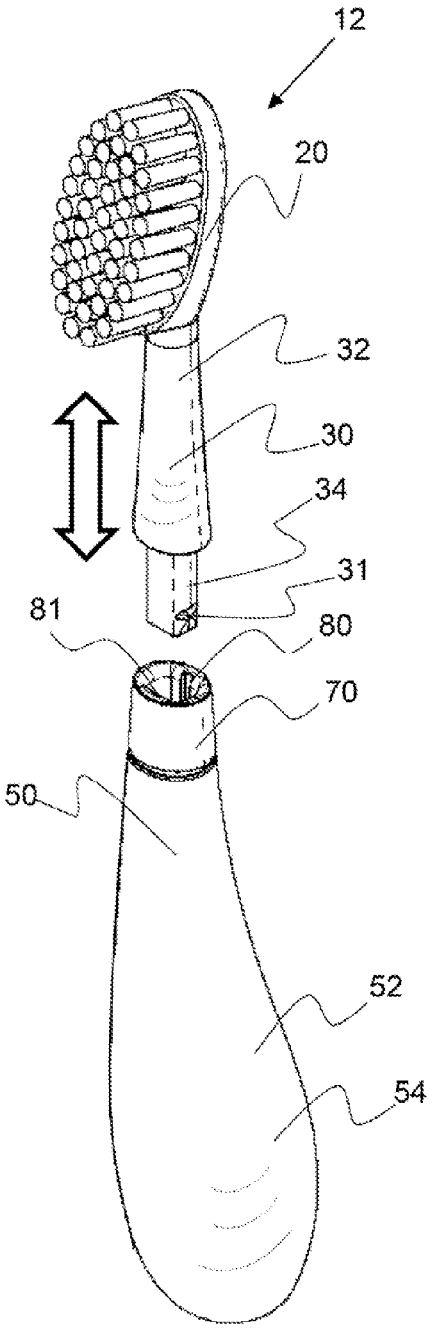

FIG. 6 shows an isometric view of an exemplary hand formable toothbrush having a toothbrush head attached to a shank and the shank being decoupled from the handle.

Figure 7:
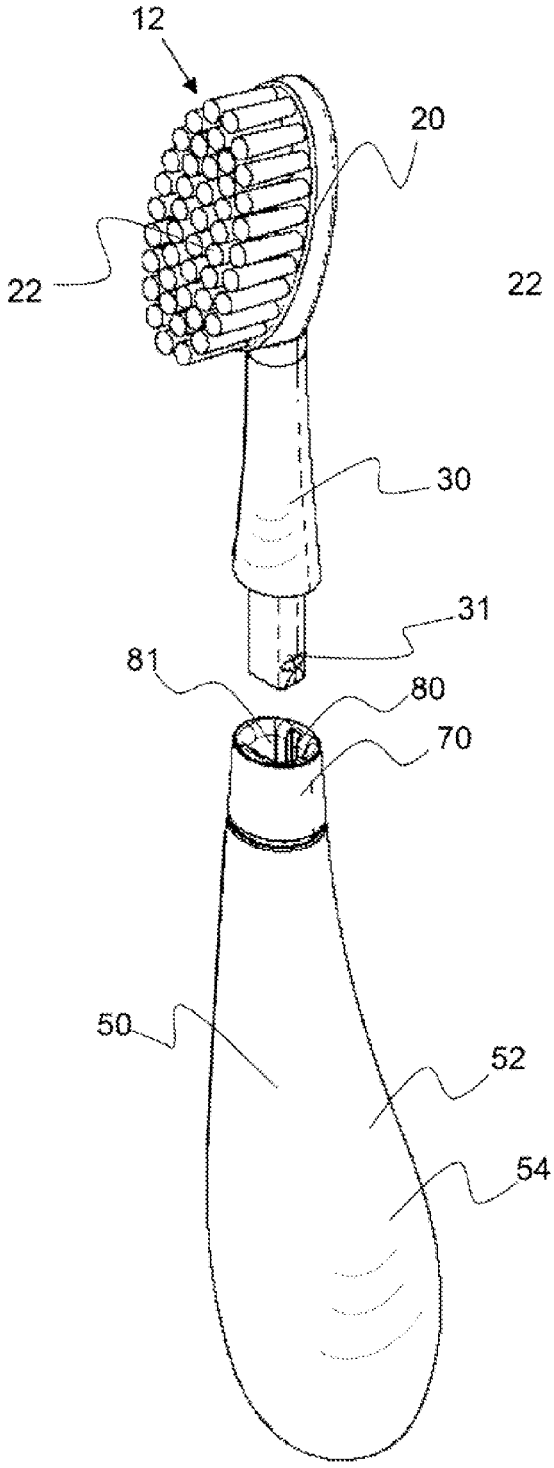
Figure 8:
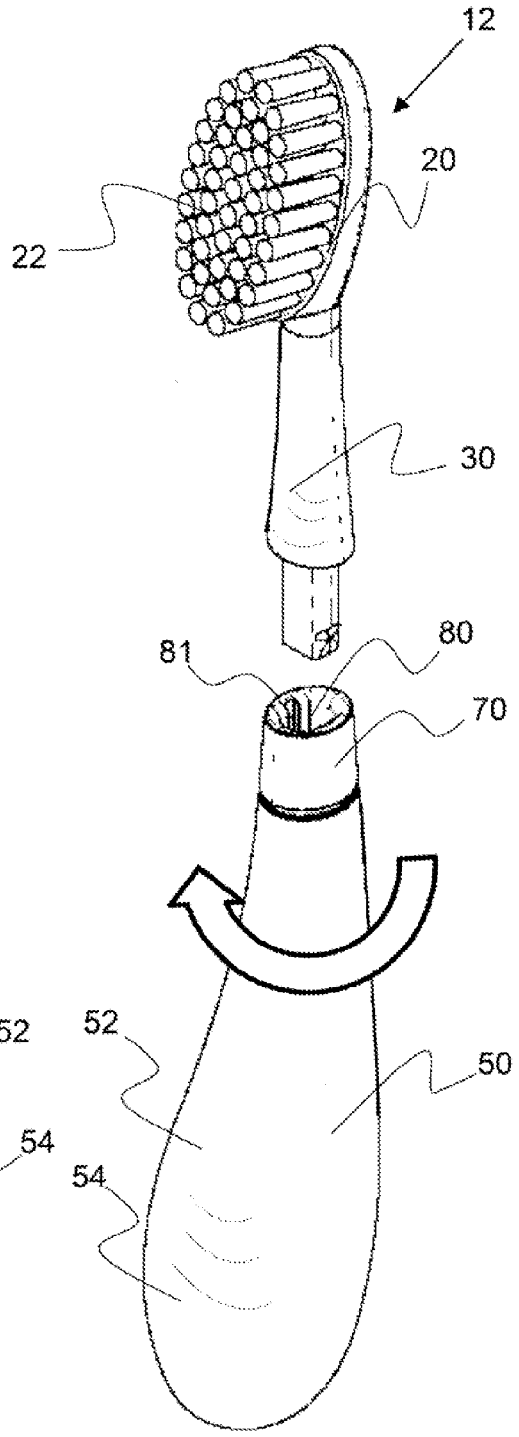

FIGS. 7 and 8 show isometric views of an exemplary hand formable toothbrush having a shank configured over a handle in right-handed and left-handed configurations, respectively.

Figure 9:
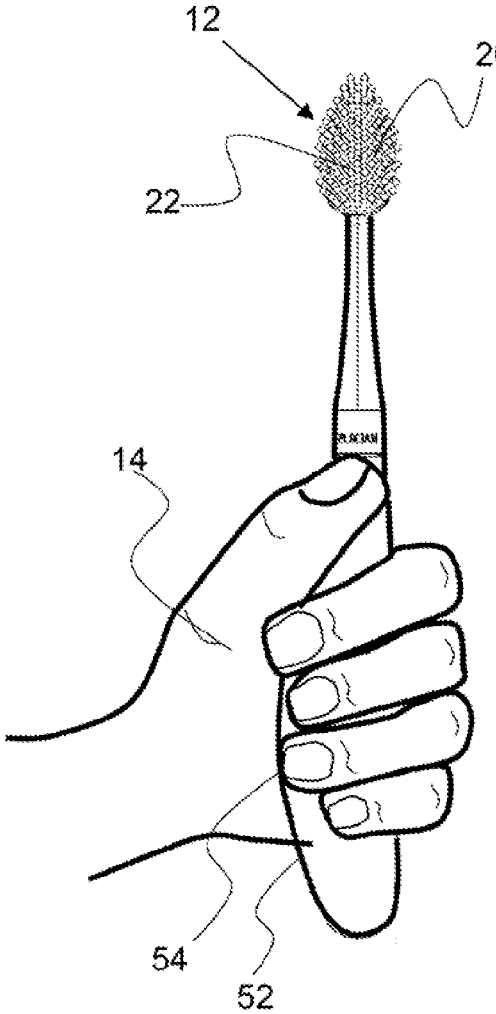

FIG. 9 shows a front view of an exemplary hand formable toothbrush in a left-handed configuration.

Figure 10:
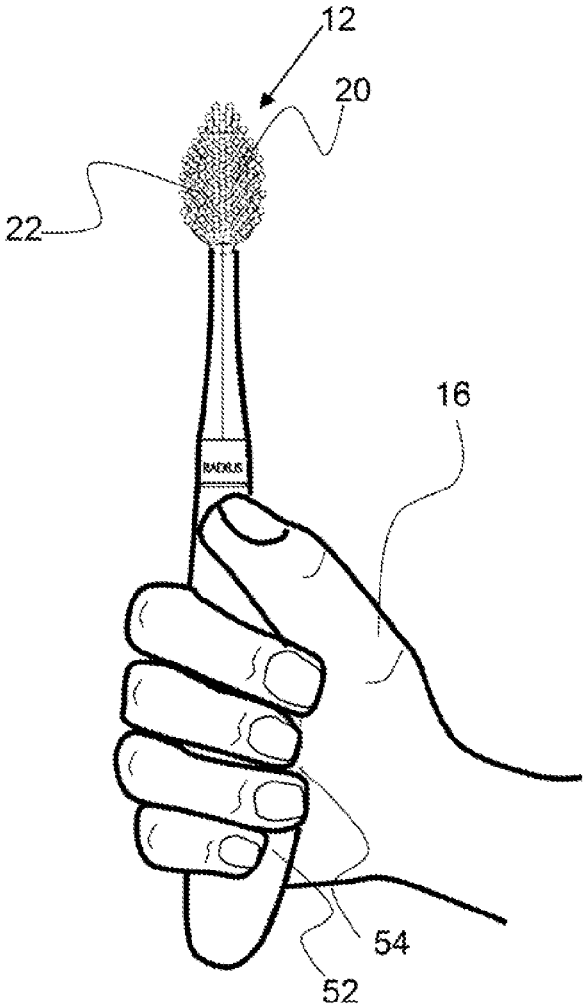

FIG. 10 shows a front view of an exemplary hand formable toothbrush in a right-handed configuration.

Figure 11A:
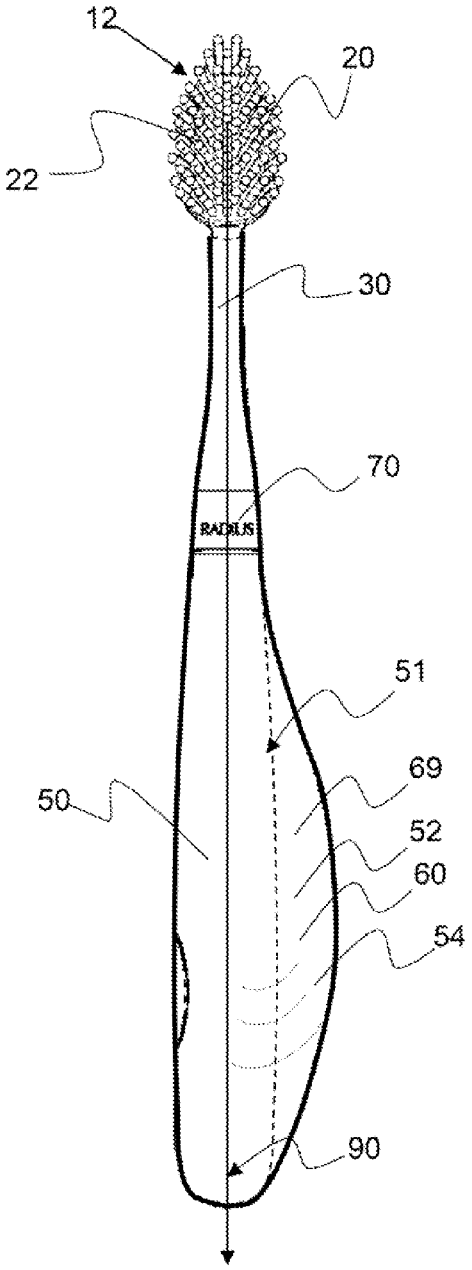

FIG. 11A shows a front view of an exemplary hand formable toothbrush having an asymmetric geometry and a palm portion on the handle.

Figure 11B:
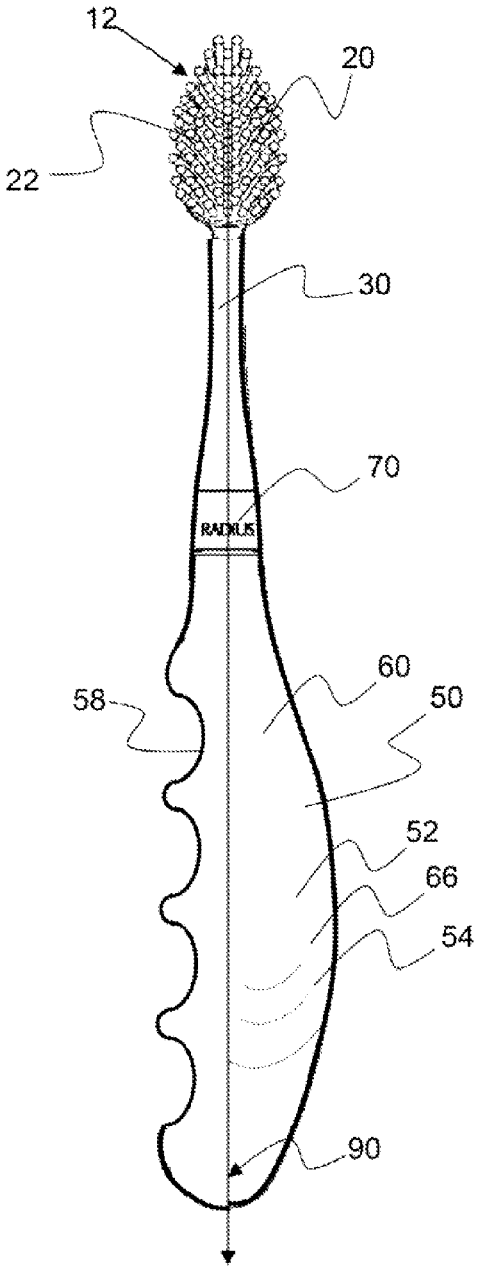

FIG. 11B shows a front view of an exemplary hand formable toothbrush having an asymmetric geometry and a palm portion and four finger recesses on the handle.

Figure 12:
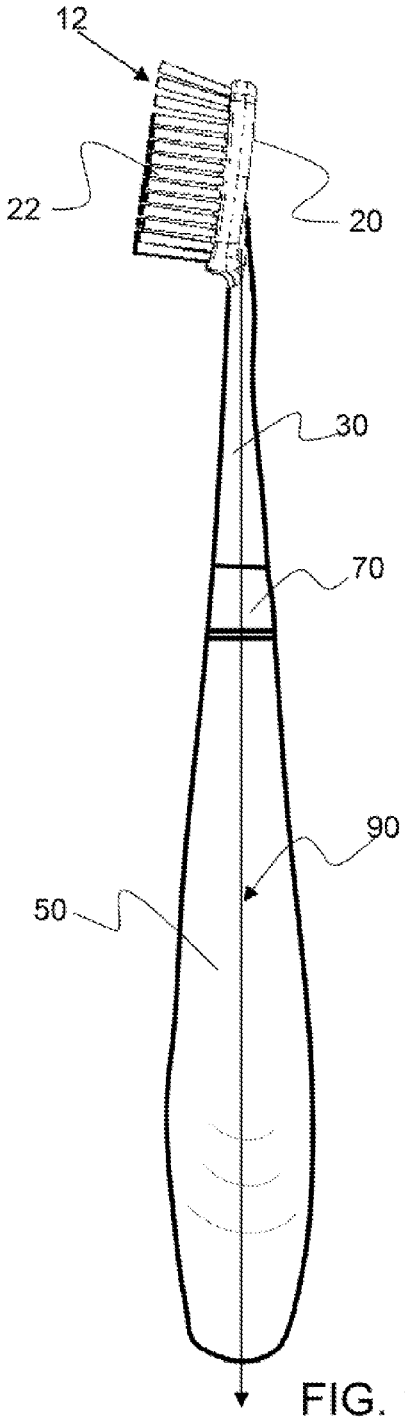

FIG. 12 shows a side view of an exemplary hand formable toothbrush.

Figure 13:
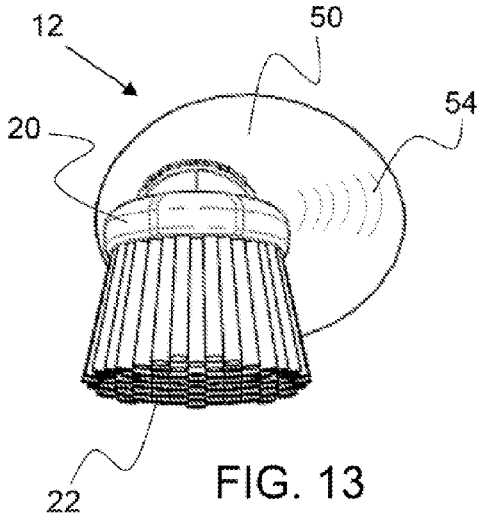

FIG. 13 shows a top-down view of an exemplary hand formable toothbrush that is configured in a right-handed orientation.

Figure 14:
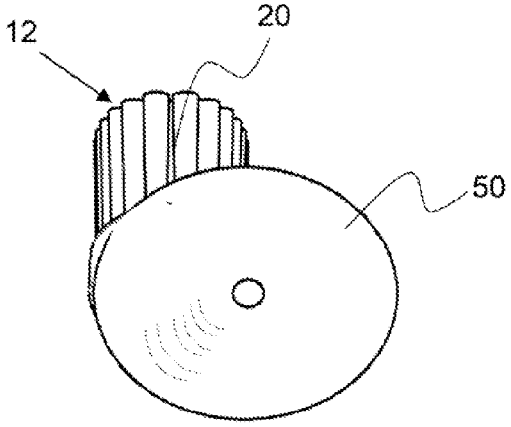

FIG. 14 shows a bottom-up view of an exemplary hand formable toothbrush that is configured in a right-handed orientation.

Figure 15A:
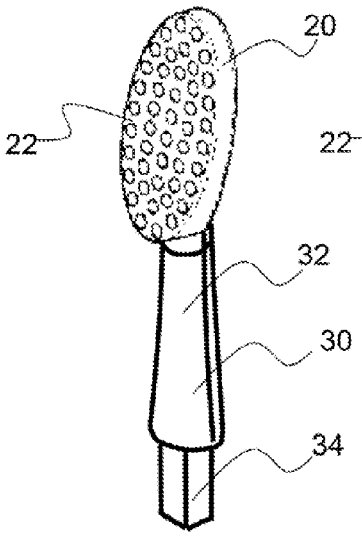

FIG. 15A shows an isometric view of an exemplary toothbrush head having a shank attached.

Figure 15B:
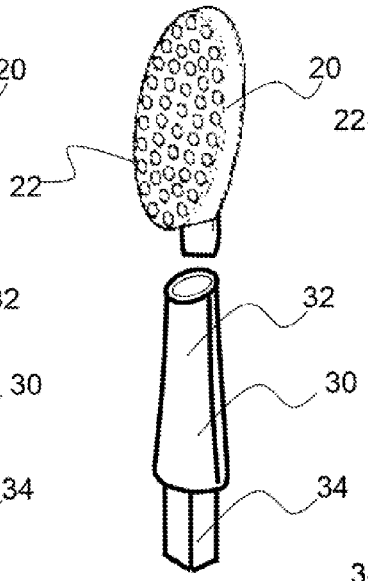

FIG. 15B shows an isometric view of an exemplary toothbrush head detached from a shank.

Figure 16:
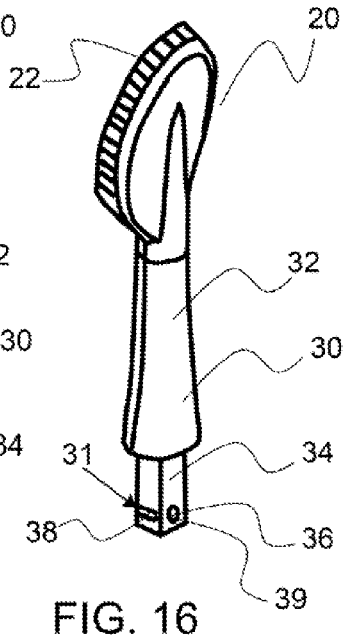

FIG. 16 shows an isometric back view of an exemplary toothbrush head having a shank attached.

Figure 17:
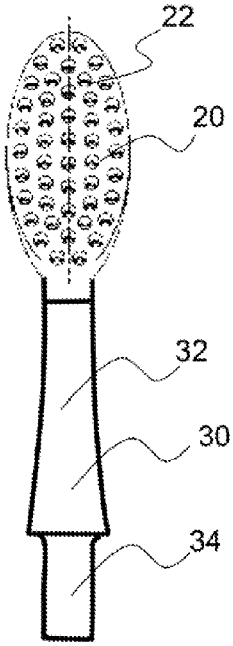

FIG. 17 shows a front view of an exemplary toothbrush head having a shank attached.

Figure 18:
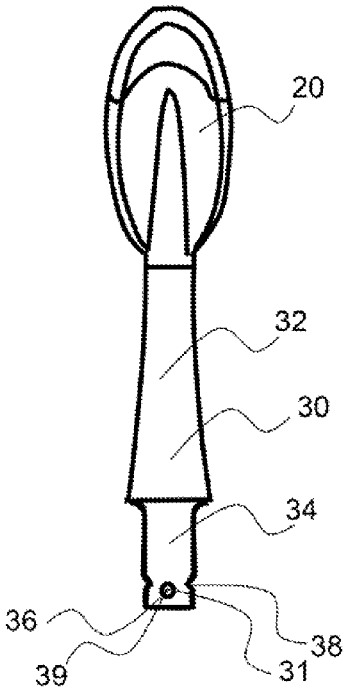

FIG. 18 shows a back view of an exemplary toothbrush head having a shank attached.

Figure 19:
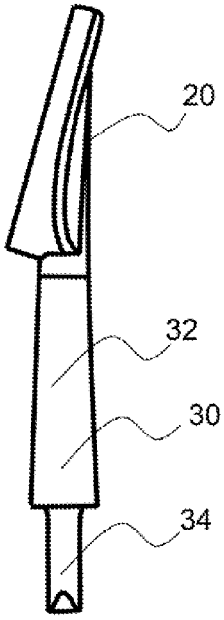

FIG. 19 shows a side view of an exemplary toothbrush head having a shank attached.

Figure 20:
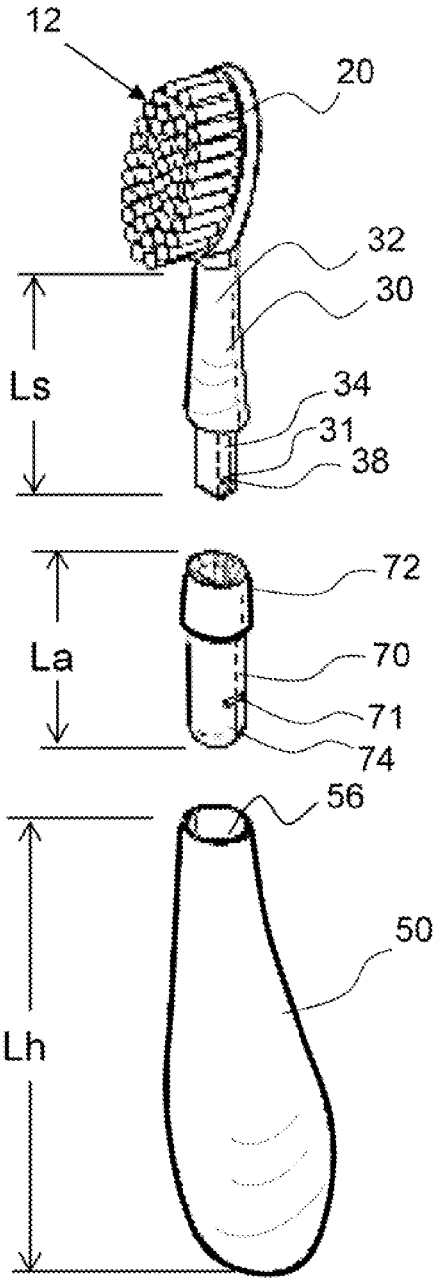

FIG. 20 shows an exploited isometric view of an exemplary hand formable toothbrush.

Figure 21:
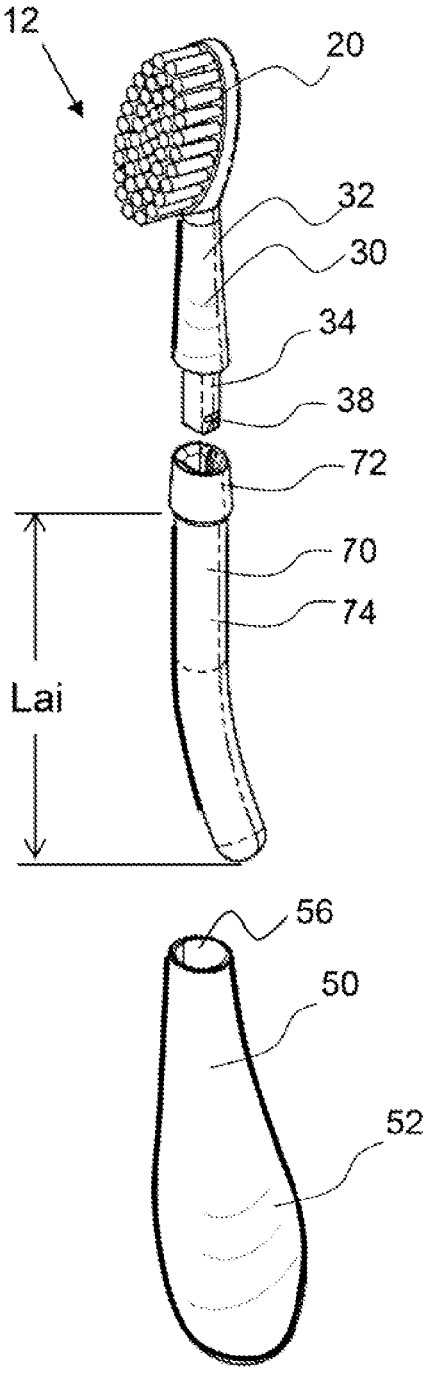

FIG. 21 shows an exploded isometric view of an exemplary hand formable toothbrush.

Figure 22:
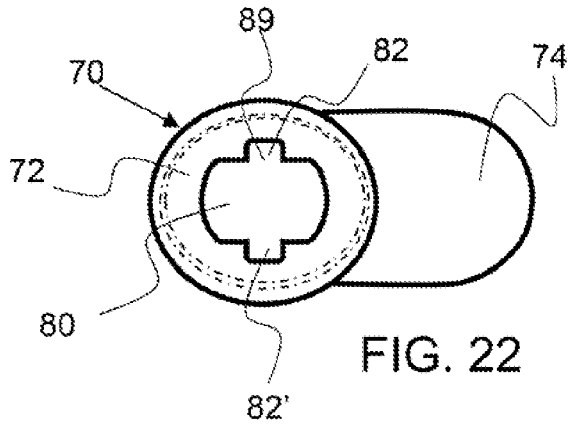

FIG. 22 shows top-down view of an exemplary armature.

Figure 23:
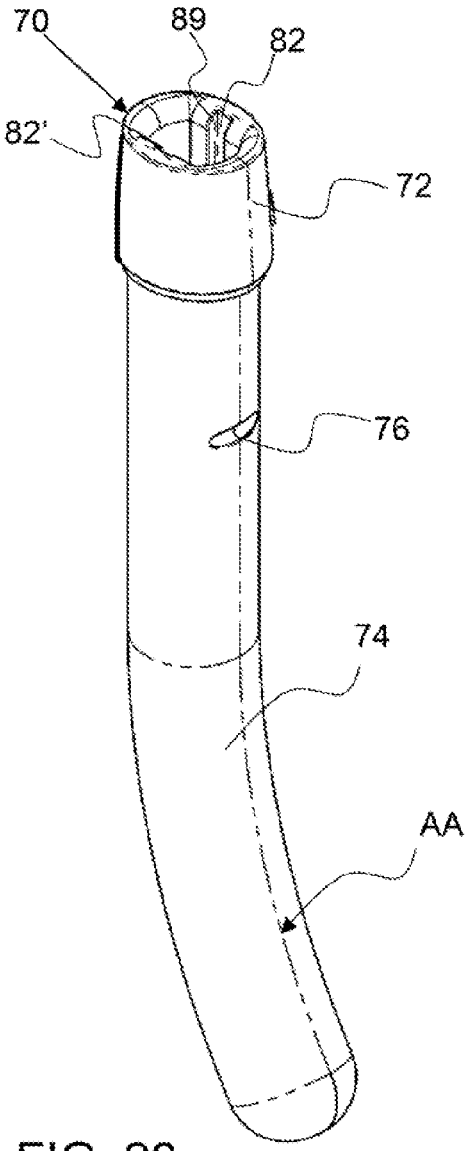

FIG. 23 shows an isometric view of an exemplary armature.

Figure 24:
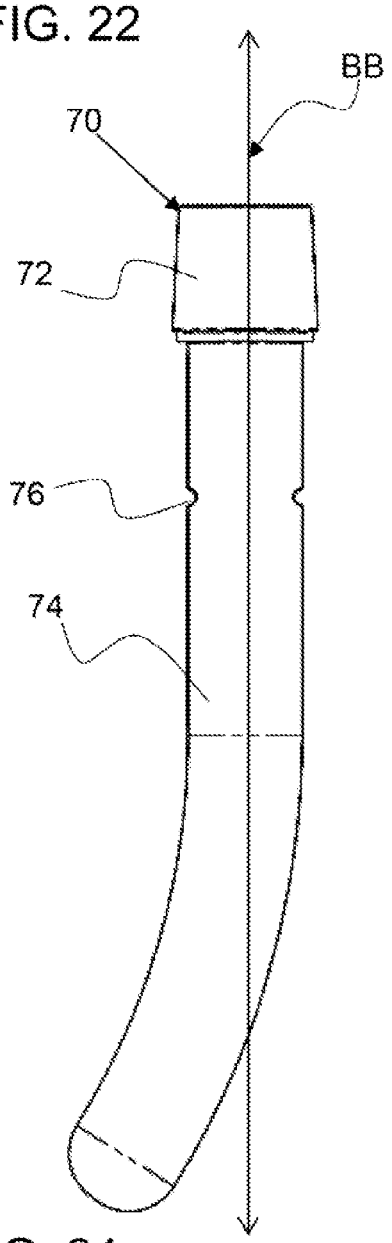

FIG. 24 shows a side view of an exemplary armature.

Figure 25:
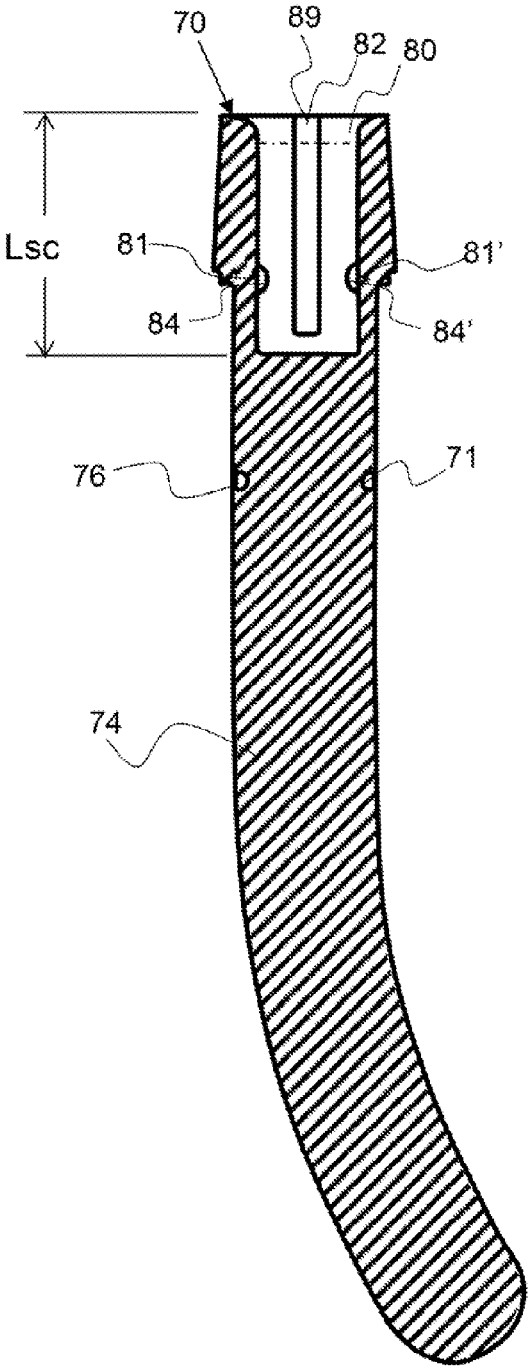

FIG. 25 shows a cross-sectional view of the armature shown in FIG. 23 along line AA.

Figure 26:
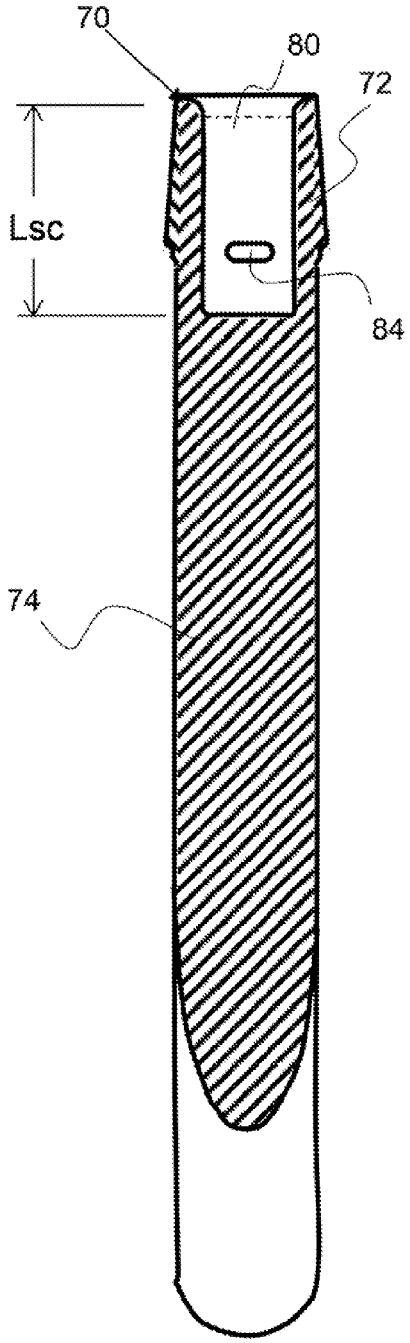

FIG. 26 shows a cross-sectional view of the armature shown in FIG. 24 along line BB.

Figure 27:
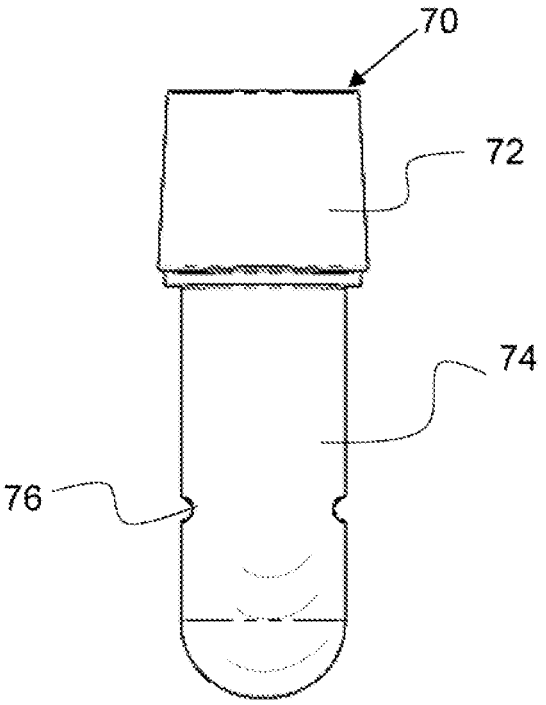

FIG. 27 shows a side view of an exemplary armature.

Figure 28:
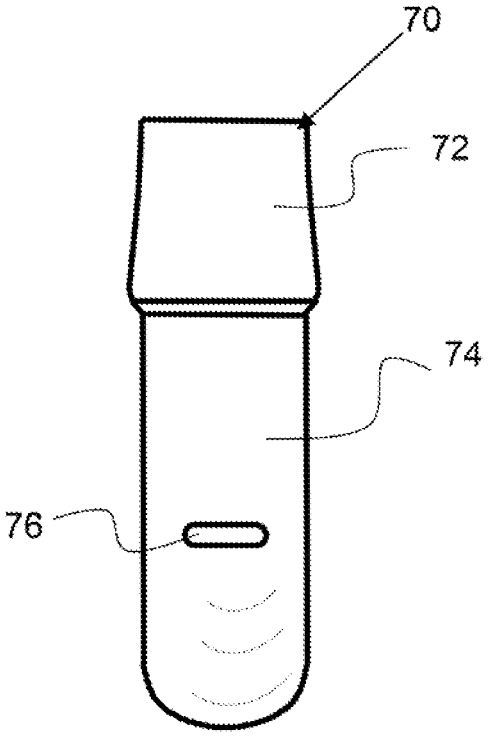

FIG. 28 shows a side view of an exemplary armature.

Figure 29:
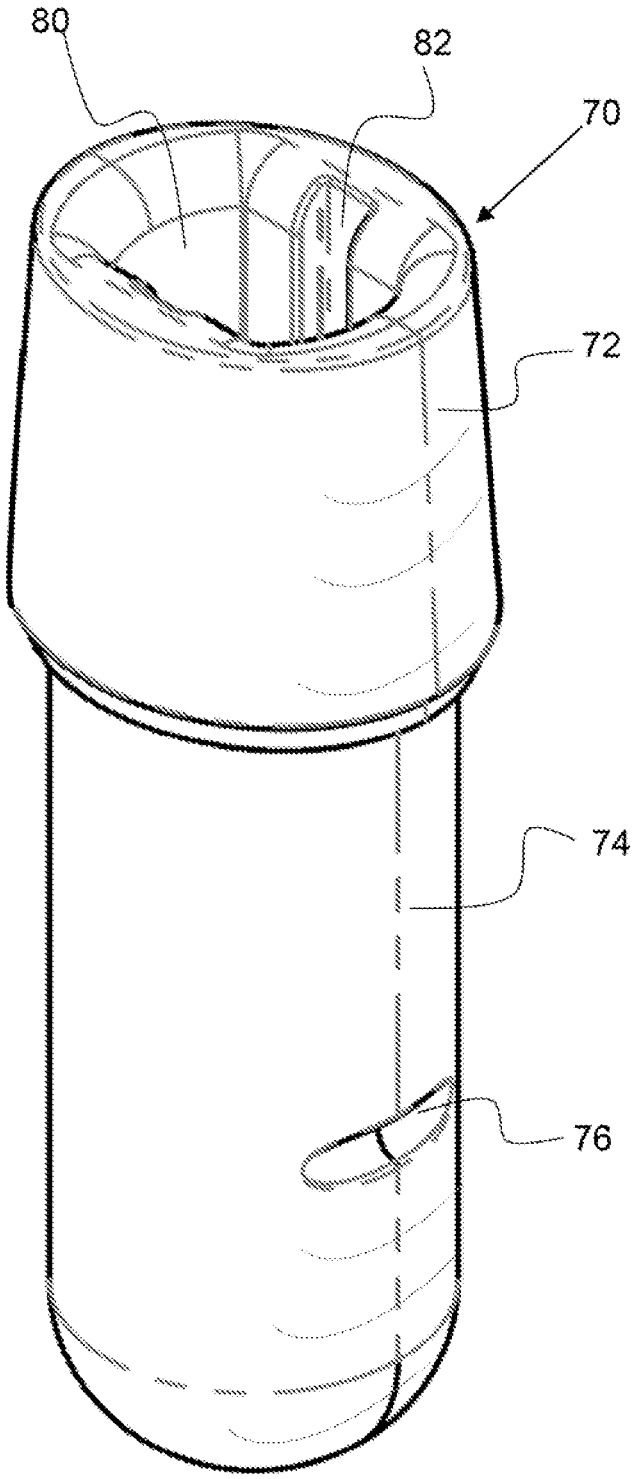

FIG. 29 shows an isometric view of an exemplary armature.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments will occur to those skilled in the art and all such alternate embodiments, combinations, modifications improvements are within the scope of the present invention.

As shown in FIG. 1A, an exemplary hand formable toothbrush 12 has a toothbrush head 20 attached to a shank 30 and a handle 50 comprising a formable handle portion 60. The handle is symmetric about a centerline 90, whereby the outer surface of the handle extends substantially a uniform distance from the centerline along the length of the centerline. Formable material 62 is configured on the outer surface of the handle.

As shown in FIG. 16, the hand formable toothbrush 12 shown in FIG. 1A has, been shaped in a user's hand to create a formed handle 66, wherein the formable handle portion 60 has been shaped to conform to a user's hand geometry. The formed handle 66 is asymmetric about the centerline 90, having finger recess 58 along one side and a palm portion extending out from the centerline on the opposing side. This type of handle geometry would allow for a positive and secure grip of the toothbrush.

As shown in FIG. 2, an exemplary hand formable toothbrush 12 is in a vessel 94 containing heated water 96. The handle portion of the toothbrush may be placed into heated liquid, such as water, and heated to an elevated temperature for a period of time to effectively soften the formable material 62. The toothbrush may then be removed from the heated liquid and allowed to cool to a desired and safe temperature before grasping in a user's hand to form the formable handle portion 60 to the shape of the user's hand. In some embodiments, the handle portion of the hand, formable toothbrush may be separated from the shank and heated separately, thereby reducing exposure of the other parts of the toothbrush to the elevated temperature.

As shown in FIG. 3, the hand formable toothbrush 12 shown in FIG. 2 has been removed from the heated liquid and is being formed into the shape of a user's 17 hand to form a formed handle 66, such as is shown in FIG. 1B.

As shown in FIG. 4A, a hand formable toothbrush 12 has an armature 70 extending down within the handle 50. The armature is shown in dashed lines as it extends down into the handle substantially along the centerline of the handle. The armature length, La, extends substantially the entire length of the handle Lh, or more than about 75% of the length of the handle. The socket extends along the length of the armature.

As shown in FIG. 4B, a hand formable toothbrush 12 has an armature 70 extending down within the handle 50, and a socket that extends a length Lsk that is only a portion of the length of the armature La.

As shown in FIG. 5, an exemplary hand formable toothbrush 12 has a toothbrush head 20, a shank 30 and a handle 50. The handle has a formed handle 66 that has an asymmetric geometry 52 including a protrusion that extends to one side of the centerline 90 of the toothbrush, or a palm protrusion 54 configured to conform to a user's palm. The dashed line to the right side of the centerline 90 of the toothbrush handle is a symmetry line 51 showing how much the palm portion 54 extends out from what would be a symmetric toothbrush handle. The palm portion 54 is a curved protrusion from the symmetry line or centerline.

As shown in FIG. 6, an exemplary hand formable toothbrush 12 has a toothbrush head 20 attached to a shank 30. The shank is detached from the handle 50. The shank may be inserted into the socket 80 and thereby attached to the handle 50. The socket comprises a socket attachment feature 81 that is configured to retain the shank in the socket. The shank comprises a shank attachment feature 31, such as a recess, that is configured to nest with a socket attachment feature, such as a protrusion, when the shank is inserted into the socket.

As shown in FIG. 7, an exemplary hand formable toothbrush 12 has a shank 30 configured over a handle 50 in a right-handed configuration. As shown in FIG. 8 an exemplary hand formable toothbrush 12 has a shank 30 configured over a handle 50 in a left-handed configuration. The shank, and therefore the attached toothbrush head, may be configured in a first orientation and a second orientation that is 180 degrees from the first orientation.

As shown in FIG. 9, an exemplary hand formable toothbrush 12 is in a left-handed configuration. The user's left hand 14 is holding the hand formable toothbrush 12 with the palm portion 54 of the handle configured in the user's palm. As shown if FIG. 10, an exemplary hand formable toothbrush 12 is in a right-handed configuration and is held in user's right hand 16 with the palm portion 54 of the handle configured in the user's palm.

As shown in FIG. 11A, an exemplary hand formable toothbrush 12 has a pre-shaped asymmetric handle 69 comprising an asymmetric geometry 52. A hand formable toothbrush may be provided with a pre-shaped asymmetric handle 69 that generally conforms to a left or right hand shape. The dashed line to the right side of the centerline 90 of the toothbrush handle is a symmetry line 51 showing how much the palm portion 54 extends out from what would be a symmetric toothbrush handle. A pre-shaped asymmetric handle may allow for easier shaping of the formable handle portion 60 into the shape of a user's hand.

As shown in FIG. 11B, an exemplary hand formable toothbrush 12 has a formed handle 66 comprising an asymmetric geometry 52, a palm portion 54 and four finger recesses 58 on the handle. The finger recesses are depressions in the handle, shaped to conform to a person's fingers. As shown in FIG. 11B the finger recesses are substantially on an opposing side of the handle from the palm portion. The toothbrush handle 50 shown in FIG. 11B has no symmetry from a first side to a second side.

As shown in FIG. 12, an exemplary hand formable toothbrush 12 comprises a handle 50 that is symmetric from the first side to second side.

FIG. 13 shows a top-down view of an exemplary hand formable toothbrush 12 wherein the handle 50 has a protrusion to one side, as shown in FIG. 7, for example. FIG. 14 shows a bottom-up view of the same exemplary hand formable toothbrush 12 shown in FIG. 13.

As shown in FIG. 15A, an exemplary toothbrush head 20 has a shank attached 30. As shown in FIG. 15B, an exemplary toothbrush head 20 is detached from a shank 30. The toothbrush head 20 may be inserted into an orifice within the shank to detachably attach the toothbrush head.

As shown in FIG. 16, an exemplary toothbrush head 20 has a shank 30 comprising a shank attachment feature 31 on the extended end of the shank. The attachment feature comprises a shank recess. The shank further comprises a shank alignment feature 39. The shank alignment feature 39 is a shank protrusion 36 that extends from the surface of the extended end of the shank.

As shown in FIGS. 17-19, an exemplary toothbrush head 20 has a shank 30 attached. As shown if FIG. 18, an exemplary toothbrush head 20 has a shank 30 comprising a shank attachment 31 and shank alignment feature 39.

As shown in FIG. 20, an exemplary hand formable toothbrush 12 comprises a toothbrush head 20 attached to a shank 30, an armature 70 and a handle 50. The armature is configured to extend down into the handle and the handle may be molded around the armature. The armature may comprise one or more armature attachment features 71 to retain the armature within the handle. An armature attachment feature may be a recess or protrusion from the outer surface of the armature. The length of the armature, La, is shown in FIG. 20 The armature shown in FIG. 20 is much shorter in length than the armature shown in FIG. 21. In addition, the armature shown in FIG. 20 has a straight extension, or has a symmetric geometry along the length axis of the armature. The armature cap 72 is configured to extend out from the handle and may have an enlarged size to rest on the top of the handle. The armature 70 is configured to fit within the handle socket 56. Again, the armature may be permanently attached to the handle, such as by molding, to create a one-piece unit. A shank recess 38 attachment feature is shown being configured on the extended end of the shank 30.

As shown in FIG. 21, an exemplary hand formable toothbrush 12 has an armature that has a contoured shape. The contoured shape of the armature is configured to align with the asymmetric geometry 52 of the handle 50.

As shown in FIG. 22, the exemplary armature 70 shown in FIGS. 23 and 24 comprises an insert portion and an armature cap 72. A socket 80 having an opening in the armature cap comprises a socket alignment feature 89 comprising first socket channel 82 and a second socket channel 82' configured on an opposite side of said socket from the first socket channel.

As shown in FIG. 23, an exemplary armature 70 comprises an armature insert portion 74, an armature cap 72, and a socket 80. The socket comprises a socket alignment feature 89 comprising two socket channels 82, 82'.

As shown in FIG. 24, an exemplary armature 70 comprises an armature insert portion 74 and an armature cap 72. An armature attachment recess 76 may be configured to retain the armature when the handle is molded there around.

FIG. 25 shows a cross-section of the armature shown in FIG. 23 along line AA. The cross-sectional view shows the plurality of socket attachment features 81, 81', which are protrusions. The socket alignment feature 89, or channel 82 in this case, is shown extending down along the length of the socket Lsc. A socket may extend any suitable distance down the armature.

FIG. 26 shows a cross-sectional view of the armature shown in FIG. 24 along line BB. A socket protrusion 84 is shown being configured down the length of the socket Lsc from the top of the armature.

As shown in FIGS. 27 and 28, an exemplary armature 70 has an armature cap 72 and armature insertion portion 74. The armature shown in FIGS. 27 and 28 has an armature recess 76.

As shown in FIG. 29, an exemplary armature 70 has a socket 80 with an opening in the top surface of the armature. The socket has a socket channel 82 that extends down the length of the socket and is configured to receive a shank alignment feature, such as a protrusion configured to slide within the channel.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A hand formable toothbrush comprising:

a. a toothbrush head attached to a shank;

b. a handle comprising:

an armature consisting essentially of a rigid material; and a formable handle portion configured around said armature and consisting essentially of a thermally formable material;

wherein the armature and formable handle are different materials;

c. an armature socket configured within said armature and comprising a socket attachment feature;

wherein said shank comprises a shank attachment feature for detachably attaching said shank into said armature socket;

whereby said formable handle portion can be heated and subsequently formed to a shape of a user's hand to create an asymmetric handle, and wherein said asymmetric handle comprises an asymmetric geometry about a centerline of said handle and comprises a hand specific geometry.

2. The hand formable toothbrush of claim 1, wherein the armature socket comprises:

a. a first attachment feature on a first side of said socket; and b. a second attachment feature on a second and opposing side to said first side of said armature socket, whereby the shank can be configured such that the toothbrush is in a left-handed or a right-handed configuration.

3. The hand formable toothbrush of claim 2, wherein the armature socket first and second attachment features comprise a socket protrusion.

4. The hand formable toothbrush of claim 1, wherein the armature socket comprises:

a. a first alignment feature on a first side of said socket; and b. a second alignment feature on a second and opposing side to said first side of said socket, wherein the shank comprises a shank alignment feature, whereby said shank can only be inserted into said socket with the shank alignment feature aligned with one of said first or second socket alignment features such that the toothbrush can be configured in a left-handed or a right-handed configuration.

5. The hand formable toothbrush of claim 4, wherein the armature socket first and second alignment features comprise a socket channel and the shank alignment feature comprises a protrusion configured to fit within said socket channel.

6. The hand formable toothbrush of claim 1, wherein the asymmetric handle comprises at least one finger recess.

7. The hand formable toothbrush of claim 1, wherein the handle has a handle length and the armature socket extends more than one-half of said handle length.

8. The hand formable toothbrush of claim 1, wherein the armature socket comprises:

a. a first attachment feature on a first side; and b. a second attachment feature on a second and opposing side to said first side of said armature socket, whereby the shank can be configured within said armature socket such that the toothbrush is in a left-handed or a right-handed configuration; and wherein the armature socket first and second attachment features comprise a socket recess.

9. The hand formable toothbrush of claim 8, wherein the shank comprises a shank alignment feature, whereby said shank can only be inserted into said armature socket with the shank alignment feature aligned with one of said first or second armature socket alignment features such that the toothbrush can be configured in a left-handed or a right-handed configuration.

10. The hand formable toothbrush of claim 9, wherein the armature socket first and second alignment features comprise a socket channel, and the shank alignment feature comprises a protrusion configured to fit within said socket channel.

11. The hand formable toothbrush of claim 1, wherein said toothbrush is a manual toothbrush.

12. The hand formable toothbrush of claim 1, wherein the shank and toothbrush head are a one-piece unit.

13. The hand formable toothbrush of claim 1, wherein the toothbrush head is detachably attachable to the shank.

14. The hand formable toothbrush of claim 1, wherein said formable handle portion comprises ethylene vinyl acetate (EVA).

15. A hand formable toothbrush comprising:

a. a toothbrush head attached to a shank;

wherein the shank comprises a shank attachment feature;

b. a handle comprising:

an armature consisting essentially of a rigid material; and a formable handle portion configured around said armature and consisting essentially of a thermally formable material;

wherein the armature and formable handle are different materials;

a. an armature socket configured within said armature and comprising a i. a first socket attachment feature; and ii. a second socket attachment feature;

wherein said shank comprises a shank attachment feature for detachably attaching said shank into said armature socket;

whereby said formable handle portion can be heated and subsequently formed to a shape of a user's hand to create an asymmetric handle portion, wherein said asymmetric handle portion comprises an asymmetric geometry about a centerline of said handle and comprises a hand specific geometry;

wherein said first attachment feature is configured on a first side of said armature socket and said second attachment feature is configured on a second and opposing side to said first side of said armature socket, and whereby said shank can be inserted into and attached to said socket such that the toothbrush is in a left-handed or a right-handed configuration.

16. The hand formable toothbrush of claim 15, wherein the socket first and second attachment features comprise a socket recess.

17. The hand formable toothbrush of claim 15, wherein the socket comprises:

a. a first alignment feature on a first side of said socket; and b. a second alignment feature on a second and opposing side to said first side of said socket, wherein the shank comprises a shank alignment feature, whereby said shank can only be inserted into said socket with said shank alignment feature aligned with one of said first or second socket alignment features such that the toothbrush can be configured in a left-handed or a right-handed configuration.

18. The hand formable toothbrush of claim 17, wherein the socket first and second alignment features comprise a socket channel, and the shank alignment feature comprises a protrusion configured to fit within said socket channel.

* * * * *